US010399649B1

(12) United States Patent
Tate et al.

(10) Patent No.: US 10,399,649 B1
(45) Date of Patent: Sep. 3, 2019

(54) MARINE NAVIGATIONAL LIGHT FIXTURE HAVING SUB-HOUSING WITH BUILT-IN CUTOFFS

(71) Applicant: Brunswick Corporation, Lake Forest, IL (US)

(72) Inventors: Robert Tate, South Haven, MI (US); Donald J. Olsen, Greenville, MI (US); Philip Wetzel, Greenville, MI (US); Anuj Maloo, Lowell, MI (US)

(73) Assignee: Brunswick Corporation, Mettawa, IL (US)

( * ) Notice: Subject to any disclaimer, the term of this patent is extended or adjusted under 35 U.S.C. 154(b) by 3 days.

(21) Appl. No.: 15/703,569

(22) Filed: Sep. 13, 2017

Related U.S. Application Data

(60) Provisional application No. 62/403,375, filed on Oct. 3, 2016, provisional application No. 62/453,034, filed on Feb. 1, 2017.

(51) Int. Cl.
*B63B 45/02* (2006.01)

(52) U.S. Cl.
CPC ..... *B63B 45/02* (2013.01); *B63B 2201/08* (2013.01)

(58) Field of Classification Search
CPC ..... B63B 45/00; B63B 45/02; B63B 45/04; B63B 45/06
USPC ..... 362/477, 459, 114, 441
See application file for complete search history.

(56) References Cited

U.S. PATENT DOCUMENTS

| | | | | |
|---|---|---|---|---|
| 7,021,801 | B2 | 4/2006 | Mohacsi | |
| 7,055,995 | B1 * | 6/2006 | Condon | B63B 45/04 359/641 |
| 7,264,384 | B1 * | 9/2007 | Ryan | B63B 17/02 362/477 |
| 7,572,043 | B2 | 8/2009 | Kolstee et al. | |

(Continued)

FOREIGN PATENT DOCUMENTS

| | | | |
|---|---|---|---|
| EP | 2058176 | A1 | 5/2009 |
| WO | 2005087542 | A1 | 9/2005 |

OTHER PUBLICATIONS

American Boat & Yacht Council, Inc., "ABYC A-16 Electric Navigation Lights", dated Jul. 2011.

(Continued)

*Primary Examiner* — Edwyn Labaze
(74) *Attorney, Agent, or Firm* — Andrus Intellectual Property Law, LLP

(57) ABSTRACT

A marine navigational light fixture includes a light source and a cutoff sub-housing holding the light source. The cutoff sub-housing has a main frame having first and second laterally opposite sides; first and second sidewalls projecting from the first and second sides of the main frame, respectively; and first and second cutoff surfaces located on the first and second sidewalls, respectively. The first and second cutoff surfaces are configured to provide practical cutoff of light emitted from the light source outside of a specified arc of visibility. The marine navigational light fixture also includes a main housing holding the cutoff sub-housing. A luminaire subassembly for the marine navigational light fixture includes a colored component having a color that is in the same color family as a color of light emitted from the luminaire subassembly. The colored component can be a lens, a filter cap, a PCB, and/or a telltale.

20 Claims, 7 Drawing Sheets

(56) References Cited

U.S. PATENT DOCUMENTS

| | | | | |
|---|---|---|---|---|
| 7,766,515 | B2 | 8/2010 | Condon et al. | |
| 8,104,941 | B2 | 1/2012 | Kolstee et al. | |
| 8,545,046 | B2 | 10/2013 | Ng | |
| 2001/0024369 | A1* | 9/2001 | Kitchin | B63B 45/02 362/477 |
| 2002/0044449 | A1* | 4/2002 | von Wolske | B63B 45/00 362/477 |
| 2004/0252511 | A1* | 12/2004 | Rohlfing | B63B 45/04 362/331 |
| 2010/0103678 | A1 | 4/2010 | Van De Ven et al. | |
| 2010/0118557 | A1* | 5/2010 | Ortwein | B60Q 1/32 362/477 |
| 2012/0287656 | A1 | 11/2012 | Mi et al. | |
| 2013/0100661 | A1* | 4/2013 | McConnell | F21V 31/005 362/232 |
| 2014/0196652 | A1* | 7/2014 | Adair | B63B 45/00 114/218 |
| 2015/0123780 | A1 | 5/2015 | Condon et al. | |
| 2015/0274267 | A1* | 10/2015 | Deven | B63B 45/04 362/477 |
| 2016/0207595 | A1* | 7/2016 | Morris | B63H 21/383 |

OTHER PUBLICATIONS

Iso, "International Standard ISO 19009 Small Craft—Electric Navigation Lights—Performance of LED Lights", First Edition, dated Sep. 15, 2015.

Nautical Know How, Inc., "Navigation Lights—Sidelights", website visited on Sep. 20, 2016, available at http://www.boatsafe.com/nauticalknowhow/sidelights.htm.

* cited by examiner

MARINE NAVIGATIONAL LIGHT FIXTURE HAVING SUB-HOUSING WITH BUILT-IN CUTOFFS

CROSS-REFERENCE TO RELATED APPLICATIONS

The present application claims the benefit of U.S. Provisional Application Ser. No. 62/403,375, filed Oct. 3, 2016, and the benefit of U.S. Provisional Application Ser. No. 62/453,034, filed Feb. 1, 2017, both of which are hereby incorporated by reference herein.

FIELD

The present disclosure relates to marine navigational light fixtures, and more specifically to navigation light fixtures that are configured to be mounted to a recreational boat.

BACKGROUND

U.S. Pat. No. 3,927,314, which is incorporated herein by reference, discloses a bow light assembly for water craft including light transmitting means at the rear face thereof and arranged to transmit rays from the light source for the front lens to indicate to the operator when the bow light assembly is operating. This invention additionally provides a means for orienting and establishing the proper position of the separate green and red lenses when the light is originally assembled and additionally at re-assembly when the light has been opened for replacement of its internal light source.

U.S. Pat. No. 5,664,866, which is incorporated herein by reference, discloses a navigation light assembly for a marine craft including a base mountable to a deck or other suitable surface of a marine craft, a hemispherical lens which is sealingly attached to an interior wall in the base to form a water-tight space for containing a lightbulb and electrical contacts, and a cap which is attached to the base to securely capture the lens therebetween. A reflector disposed within the water-tight space of behind the lightbulb redirects light outward from the back of the assembly to provide efficient utilization of light emitted from the lightbulb to achieve better visibility of the light from a greater distance using a smaller lightbulb and light assembly. The efficient utilization of light from the lightbulb is further improved by employing a hemispherical Fresnel lens which focuses light along the horizon. The light assembly is easily mounted to the deck and assembled, and is free of exposed fasteners used to attach the assembly to the deck of a marine craft.

U.S. Pat. No. 5,882,109, which is incorporated herein by reference, discloses an all-round marine navigation light which generally limits the direction of light transmission to a selected angle above and a selected angle below a plane in which light transmission is to be generally directed. The navigation light generally includes a base defining a light limiting perimeter wall, a circumferential lens which allows light transmission in all directions of the selected plane, the lens being secured to the base, a cap defining a downwardly projecting light limiting perimeter wall, the cap being secured to the lens, and the upwardly and downwardly projecting perimeter walls blocking light transmission through lower and upper portions of the circumferential lens, respectively, to generally limit the direction of light transmission to a relatively narrow band generally within and/or adjacent to a selected plane. Also disclosed is an all-round marine navigation light having a light assembly, a connector configured for attachment to a pole, and the light assembly being attached to the connector through an articulated joint, whereby the orientation of the marine navigation light can be adjusted with respect to the connector to facilitate mounting of the light to a variety of sloped surfaces while generally limiting the direction of light transmission to a relatively narrow band generally within and/or adjacent to a selected plane.

SUMMARY

This Summary is provided to introduce a selection of concepts that are further described below in the Detailed Description. This Summary is not intended to identify key or essential features of potentially claimed subject matter, nor is it intended to be used as an aid in limiting the scope of potentially claimed subject matter.

A marine navigational light fixture according to one example of the present disclosure includes a light source and a cutoff sub-housing holding the light source. The cutoff sub-housing has a main frame having first and second laterally opposite sides; first and second sidewalls projecting from the first and second sides of the main frame, respectively; and first and second cutoff surfaces located on the first and second sidewalls, respectively. The first and second cutoff surfaces are configured to provide practical cutoff of light emitted from the light source outside of a specified arc of visibility. The marine navigational light fixture also includes a main housing holding the cutoff sub-housing.

According to another example of the present disclosure, a luminaire subassembly for a marine navigational light fixture includes a light engine, including a printed circuit board (PCB) supporting a light emitting diode (LED). A cutoff sub-housing holds the light engine and is configured to provide practical cutoff of light emitted from the LED outside of a specified arc of visibility. A colored component of the luminaire subassembly has a color that is in the same color family as a color of light emitted from the luminaire subassembly. The colored component comprises at least one of: a lens supported in the cutoff sub-housing and through which the light emitted from the LED passes; a filter cap supported on the PCB and through which the light emitted from the LED passes; the PCB; and a telltale projecting from the lens.

BRIEF DESCRIPTION OF THE DRAWINGS

The present disclosure is described with reference to the following Figures. The same numbers are used throughout the Figures to reference like features and like components.

DETAILED DESCRIPTION OF THE DRAWINGS

Figure 1A:
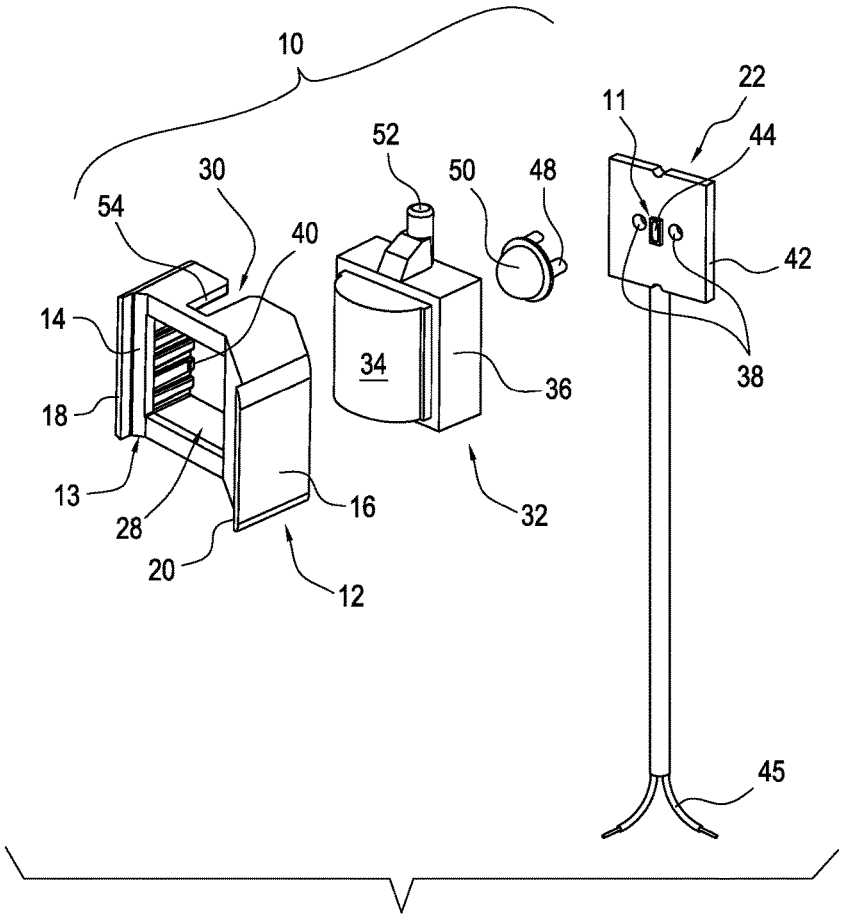
FIGS. 1A-1B illustrate an embodiment of a starboard-side marine navigational light fixture subassembly according to the present disclosure.
Figure 1B:
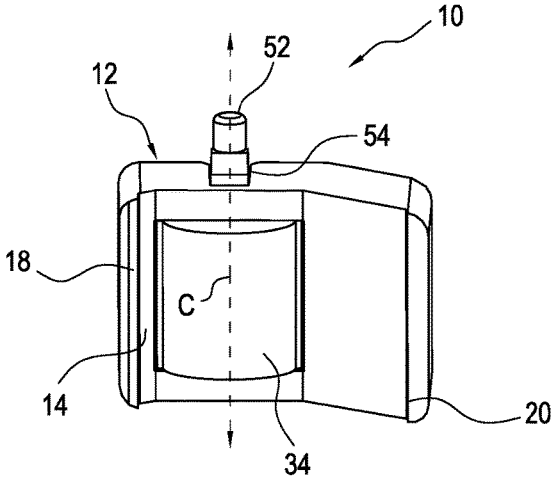

In the present description, certain terms have been used for brevity, clarity, and understanding. No unnecessary limitations are to be inferred therefrom beyond the requirement of the prior art because such terms are used for descriptive purposes only and are intended to be broadly construed. Each of the examples of assemblies provided in the Figures and in the following description can be implemented separately, or in conjunction with one another and/or with other assemblies.

The present disclosure is of a marine navigational light fixture including a cutoff sub-housing that is separate from a fixture main housing. The cutoff sub-housing meets the International Organization for Standardization (ISO) standards for marine navigation lights on small watercraft. The cutoff sub-housing can be inserted into various different designs of main housings, thereby obviating the need to have each main housing tested and certified as conforming with industry standards and federal regulations.

The present disclosure is also of a marine navigational light fixture including a colored component, such as, for example, a printed circuit board (PCB) for holding a light source. The color of the colored component matches (or is in the same color family as) the color of light that the light fixture is intended to emit, thereby obviating the need for a person to illuminate the light in order to determine its color. The colored component can be inserted into various different designs of light fixture housings, and even after being inserted in a housing, its color can be determined despite the light source not being illuminated.

Standards for watercraft design are set by the ISO and the American Boat and Yacht Council (ABYC). For example, ISO 19009 includes requirements for electric navigation lights, and more specifically performance of light-emitting diode (LED) lights, on small watercraft. The ISO standard requires that an LED light mounted on a boat and indicating a port, a starboard, or both port and starboard sides of the boat (a sidelight) must have at least a threshold intensity throughout a specified angular sweep along the horizon ("arc of visibility") and must achieve practical cutoff outside of this specified angular sweep. "Practical cutoff" is defined as a value of not greater than 12.5% of the average photometric luminous intensity of the emitted light and is accomplished by way of light cutoffs. These design criteria ensure that even if a light fixture is not mounted perfectly (for example, dead-ahead for a horizontally mounted port and starboard light fixture), the light intensity is enough that it is visible to humans from certain predetermined perspectives, but not from others. The ISO standard also requires that an LED light mounted on a boat must be of a certain color. Sidelights include a green light on the starboard side and a red light on the port side. A tri-color light at the top of a mast may include red, green, and white lights, with the white light facing the stern of the boat.

Sidelights that meet standard A-16 set by the ABYC are designed to cover an arc of the horizon of 112.5 degrees. Light intensities are required to attain a visible range of one mile for vessels less than twelve meters and two miles for vessels twelve meters or longer. Sidelights include a green light on the starboard side and a red light on the port side, each showing an unbroken light over an arc of the horizon of 112.5 degrees and fixed so as to show the light from dead ahead to 22.5 degrees abaft the beam on its respective side. Sidelight fixtures are designed for intensities to decrease and reach practical cutoff between 1 and 3 degrees outside their prescribed sector.

In order to meet previous ISO and ABYC standards, cutoffs were built into each light fixture individually. Design of such fixtures therefore required an iterative process of adjusting the cutoffs and testing the light in its housing until the standard was met. Once the standard was met as determined by a manufacturer, this would need to be independently certified by a third party before the light fixture could be certified. Therefore, potentially many different fixture designs from a single manufacturer required independent testing and certification by the third party before they were approved for use on boats. This added both time and cost to the design of a given light fixture.

The present disclosure is of a luminaire subassembly that is a separate component configured to be assembled into a main housing of a light fixture. The luminaire subassembly includes a cutoff sub-housing that holds an assembled light, including one or more of a light engine, a filter cap, and a lens that fit into the cutoff sub-housing. The light engine includes an LED chip mounted on a printed circuit board (PCB) that has electrical and mechanical components. Because the luminaire subassembly complies with ISO and ABYC standards, when it is inserted into a main housing, the assembled light fixture will therefore also comply with those standards. Thus, a single luminaire subassembly design can be used in various designs of main housings, which main housings do not need to be independently tested.

One embodiment of a starboard-side luminaire subassembly 10 for a marine navigational light fixture (see FIGS. 9A-11B) is shown in FIGS. 1A-2C. The luminaire subassembly 10 includes a light source 11 and a cutoff sub-housing 12 holding the light source 11. The cutoff sub-housing 12 includes a main frame 13 having first and second laterally opposite sides 24, 26. First and second sidewalls 14, 16 project from the first and second sides 24, 26 of the main frame 13, respectively. The first and second sidewalls 14, 16 are angled outwardly away from each other. One of the sidewalls 14 extends only a short way out from the main frame 13 and at an angle of about 54-55 degrees from a center plane C (see also FIG. 5) of the main frame 13. The other sidewall 16 extends a much longer way out from the main frame 13 and at an angle of about 58-59 degrees from the center plane C of the main frame 13. First and second cutoff surfaces 18, 20 are located on the first and second sidewalls 14, 16, respectively. For example, cutoff surface 18 is located at the far end of the sidewall 14, and cutoff surface 20 is located at the far end of the sidewall 16. Together, the cutoff surfaces 18, 20 at the ends of sidewalls 14, 16 allow light of greater than a threshold intensity to be seen from the cutoff sub-housing 12 for a total of 112.5 degrees, but the first and second cutoff surfaces 18, 20 are specifically configured to provide practical cutoff of light emitted from the light source 11 outside of this specified arc of visibility.

Figure 2A:
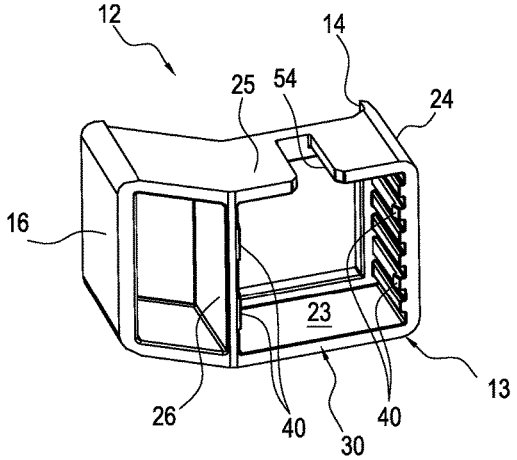
FIGS. 2A-2C illustrate views of a starboard-side cutoff sub-housing of the light fixture subassembly.
Figure 2B:
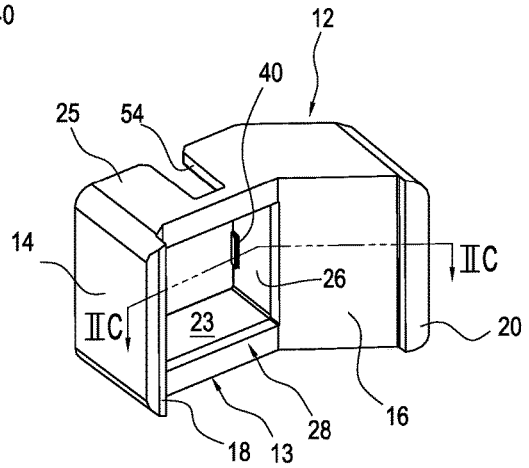
Figure 2C:
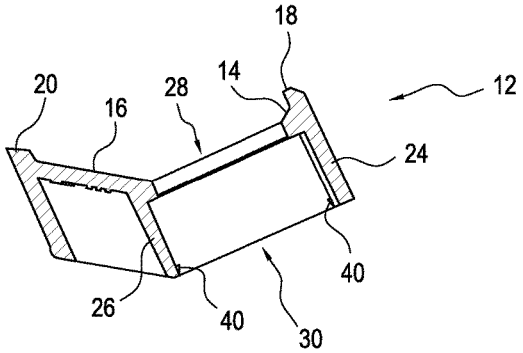
Figure 4A:
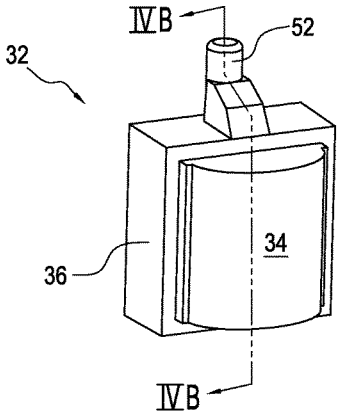
FIGS. 4A-4B illustrate views of a lens of the light fixture subassembly.
Figure 4B:
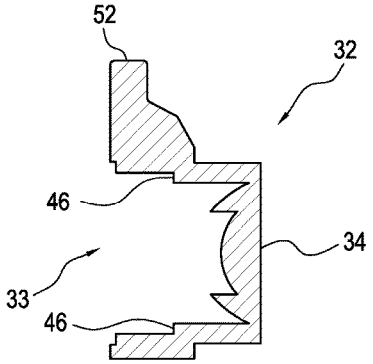

Referring to FIGS. 2A-2C, the cutoff sub-housing 12, including the above-mentioned hollowed-out rectangular main frame 13, is shown separately. The above-mentioned sidewalls 14, 16 extend from the lateral sides 24, 26 of the main frame 13, and are coextensive in height with the main frame 13, which height is defined by bottom and top sides 23, 25. The main frame 13 has an open front 28 and an open back 30. A lens 32 is held by the main frame 13, such as by insertion through the back 30 of the main frame 13, such that a convex surface 34 of the lens 32 projects through the front 28 of the main frame 13. Additional views of the lens 32 are shown in FIGS. 4A and 4B. A rectangular base 36 of the lens 32 will sit flush or almost flush with the back 30 of the main frame 13. The base 36 of the lens 32 is retained in the main frame 13 by one or more retaining tabs 40 on either the inside surface of the main frame 13 (as shown) or the outside surface of the base 36 (not shown).

Referring again to each of FIGS. 1A-2C, a light engine 22 is inserted into an open back 33 of the lens 32. The light engine 22 can be coupled with the base 36 of the lens 32, such as by a snap fit, gluing, or fastening mechanisms. The light engine 22 includes a PCB 42 that supports an LED 44. Power is provided to the LED 44 and other electrical components on the PCB 42 via electrical wires 45. Note that although the light source 11 in this example is the LED 44, other types of light sources that emit light having an intensity and color that comply with ISO and ABYC regulations could be used. If the base 36 of the lens 32 is not flush with the back 30 of the main frame 13, the PCB 42 can then be flush with the back 30 of the main frame 13 once the PCB 42 is assembled with the rest of the luminaire subassembly 10. Alternatively, with reference to FIGS. 5B and 7, the PCB 42 can be pushed into the lens 32 until it contacts a ledge 46 inside the base 36 of the lens 32.

As noted, the specified arc of visibility is defined by at least one of the ABYC A-16 standard and the ISO 19009 standard, and currently is 112.5 degrees. The design of the cutoff sub-housing 12 and how it achieves this arc of visibility will be described with respect to FIG. 5, which shows a cross-section of a port-side version 10' of the luminaire subassembly 10 of FIGS. 1A-1B. As shown, the first and second sidewalls 14', 16' are angled outwardly away from each other. The first and second cutoff surfaces 18', 20' project from the first and second sidewalls 14', 16', respectively, and the specified arc of visibility A is defined between a first line 56 connecting an origin 58 on the light source (LED 44) to the first cutoff surface 18' and a second line 60 connecting the origin 58 on the light source to the second cutoff surface 20'. Note that the lines 56, 60 are imaginary projections from the origin 58 to the very first protruding surface the emitted light will hit on either sidewall 14', 16', which is at the near corner of each cutoff surface 18', 20'. The cutoff sub-housing 12' need not have the exact same configuration as that shown herein, so long as the cutoff sub-housing holds the light engine 22 and is configured to provide practical cutoff of light emitted from the light source 11 (for example, LED 44) outside of the specified arc of visibility A. For example, the sidewalls 14', 16' could extend beyond the cutoff surfaces 18', 20', so long as the sidewalls 14', 16' do not interfere with the arc of visibility A.

The port-side cutoff sub-housing 12' is oriented such that the cutoff surfaces 18', 20' allow light to be emitted in the arc of visibility A from dead-ahead (along dashed line 60) toward the bow of the boat, to 22.5 degrees abaft (along dashed line 56) toward the port side of the boat. In contrast, the cutoff sub-housing 12 shown in FIGS. 1A-2C is designed to be used on the starboard side of a light fixture, wherein cutoff surface 20 is oriented to provide cutoff of the arc of visibility A in the dead-ahead direction, and cutoff surface 18 provides the abaft cutoff on the starboard side. Note that other portions labeled with the prime symbol on the port-side cutoff sub-housing 12' are mirror images of the same numbered portions described herein with respect to the starboard-side cutoff sub-housing 12, and will therefore not be described further herein, with the exception of a slot 54, 54', the purpose of which will be described below.

Figure 8:
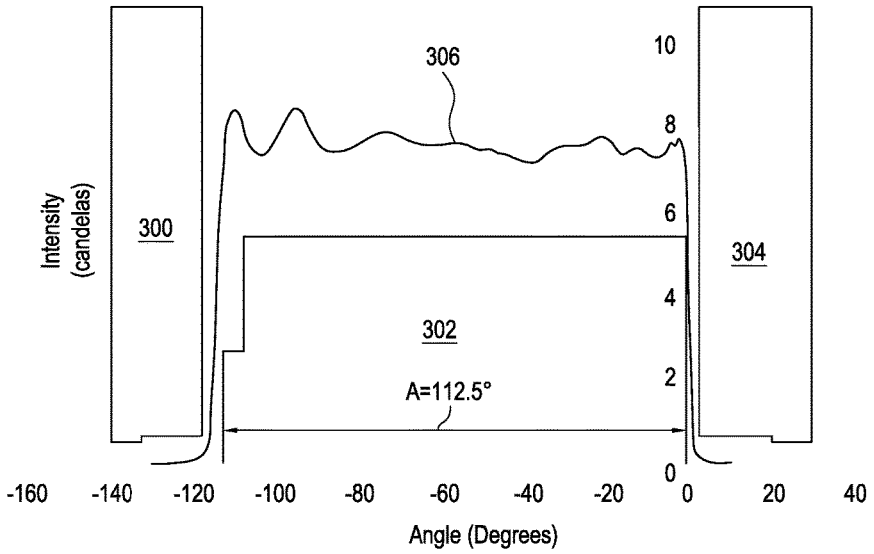
FIG. 8 provides a graphical description of the sweep of light allowed by the subassemblies of the present disclosure.

FIG. 8 shows a chart of test results for a luminaire subassembly 10' including the port-side cutoff sub-housing 12' of the present disclosure. The left box 300 shows an upper threshold for intensity (on the vertical axis) starting at the 1-3 degree from 112.5 degrees range. The middle box 302 shows the lower threshold for intensity in the 0-112.5 degree range. The right box 304 shows the upper threshold starting at the 1-3 degree from 0 degrees range. The line 306 represents the sweep of the tested port-side cutoff sub-housing 12'. It can be seen that the sweep 306 is greater than the lower threshold 302 and reaches practical cutoff (see upper thresholds 300, 304) within the 1-3 degree range from the prescribed arc. Thus, the tested cutoff sub-housing 12' meets the above-noted ISO and ABYC standards.

Because the cutoff surfaces 18, 20, 18', 20' of the cutoff sub-housings 12, 12' are packaged together with an assembled light engine 22 and positioned in a predefined manner with respect to the assembled light engine 22, the luminaire subassembly's design need only be independently verified as meeting the required standards once. The tested and approved luminaire subassemblies 10, 10' can then be used in a variety of main housings (see FIGS. 9A-11B), which, so long as the design of the main housing does not encroach upon the 112.5 degree arc of visibility A, will also meet the ISO and ABYC standards. Therefore, instead of requiring that many different main housing designs with integrated cutoffs be tested, only one version of each luminaire subassembly 10, 10' needs to be tested. In other words, once the luminaire subassemblies 10, 10' have been certified, they can be used in various main housing designs without the need to re-certify the overall light fixture.

In many of today's marine light fixtures, it is not possible to tell what color a light fixture will emit by looking at the un-lit light fixture, for example, whether it is a red light or a green light. This is because certain LEDs 44, although they emit colored light, appear relatively uncolored, especially when viewed through the thick, often curved or prismed lens 32. This could result in mounting of an incorrect colored light on an incorrect side of the boat in the case of sidelights, or incorrect orientation of a tri-color light on the mast. The process of removing and reinstalling the light fixture to fix the mistake is time consuming and potentially costly.

Therefore, in one example of the present disclosure, the luminaire subassembly 10, 10' includes a colored component having a color that is in the same color family as a color of light emitted from the luminaire subassembly 10. The colored component could be any one or more of: the lens 32 supported in the cutoff sub-housing 12, 12' and through which the light emitted from the LED 44 passes; a filter cap 50 supported on the PCB 42 and through which the light emitted from the LED 44 passes; the PCB 42; and a telltale 52 projecting from the lens 32. These examples will be described further herein below.

Figure 6A:
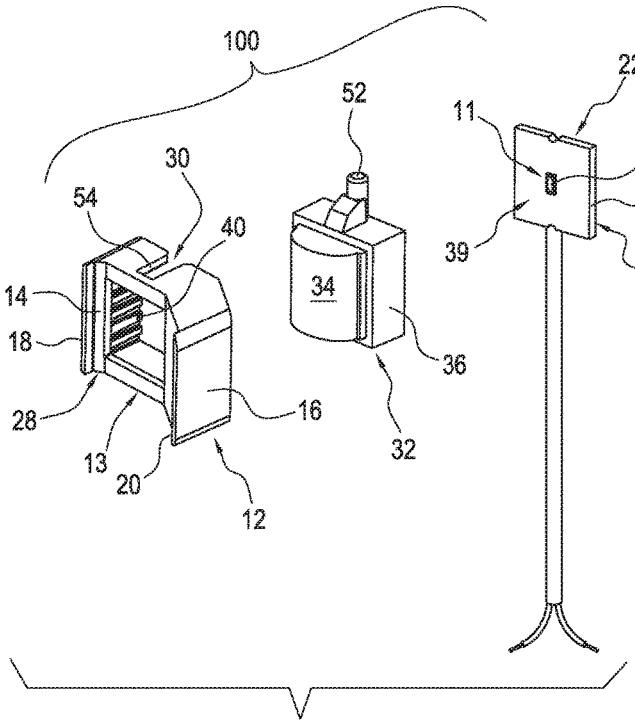
FIGS. 6A-6B illustrate another embodiment of a starboard-side marine navigational light fixture subassembly according to the present disclosure.
Figure 6B:
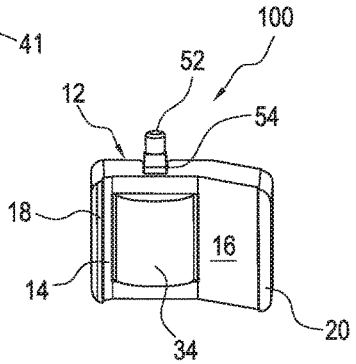
Figure 7:
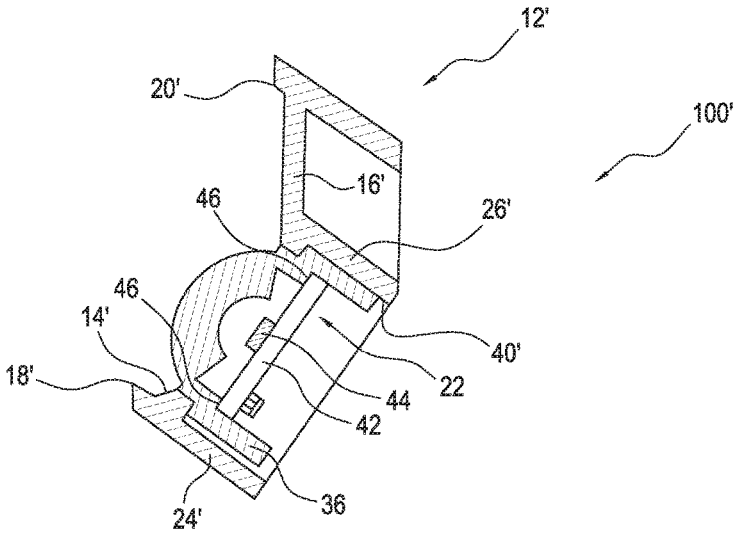
FIG. 7 illustrates a cross-sectional view of a port-side version of the subassembly of FIGS. 6A and 6B.

FIGS. 6A and 6B show another embodiment of a starboard-side luminaire subassembly 100, while FIG. 7 shows a cross section through a port-side version 100' thereof. In these embodiments, the PCB 42 of the light engine 22 is the colored component, and a color of the PCB 42 is in the same color family as a color of the light emitted from the LED 44. The color of the PCB 42 indicates what color of light the luminaire subassembly 100, 100' will emit when lit. For example, the PCB 42 can be red or green depending on whether the luminaire subassembly 100, 100' is intended to be placed on the port or starboard side of the boat. The color of the PCB 42 can be due to the PCB 42 being made of a material that is colored or due to the PCB 42 being dyed or painted after it is made. Either the front 39, the back 41, or the front 39 and back 41 of the PCB 42 can be colored. In this example, the lens 32 and its telltale 52 (or at least its convex surface 34) are (is) clear, thereby allowing the colored PCB 42 to be seen through the lens 32. In one example, the lens 32 may be made of clear polycarbonate. Having a PCB 42 that is red or green will allow one to tell the color of light emitted by the luminaire subassembly 100, 100' and what side of the boat the luminaire subassembly 100, 100' is intended for even when it is not lit. In this example of FIGS. 6A-7, because no filter cap is provided between the LED 44 and the lens 32, the LED 44 itself is colored such that it emits light that fulfills the ISO and ABYC standards. Preferably, the color of the PCB 42 is in the same color family as the color of the LED 44. For example, the color of the PCB 42 nearly or exactly matches the color of the LED 44.

Figure 5:
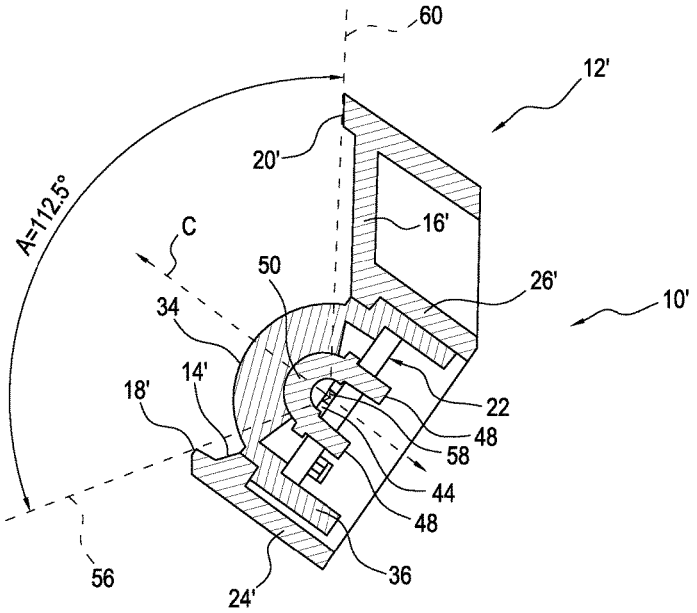
FIG. 5 illustrates a cross-sectional view of a port-side version of the subassembly of FIGS. 1A and 1B.

In other examples, as shown in FIGS. 1A and 5, a filter cap 50 and/or a colored lens 32 could be used to affect the spectrum of light coming from the LED 44. This might be the case if the color of the LED 44 and the color of the filter cap 50 and/or lens 32 are designed specifically to combine to create a red or green (or other color) light as required by ISO and ABYC standards. The PCB 42 in this example would be a color that would appear to be the desired resultant color (e.g., red or green) even when viewed through the colored lens 32 and/or filter cap 50. Note that the filter cap 50 can be attached to the PCB 42 by way of prongs 48 on the back of the filter cap 50 extending through corresponding holes 38 in the PCB 42.

In yet another example, the LED 44 of the light engine 22 is a white LED and the filter cap 50 is colored. For example, the filter cap 50 can be red or green depending on whether the luminaire subassembly 10, 10' is intended to be placed on the starboard or port side of the boat. In another example, the lens 32 (or at least its convex surface 34) is colored. Having a filter cap 50 or lens 32 that is red or green will allow one to tell the color of light to be emitted by the luminaire subassembly 10 even when it is not lit. A filter cap 50 would not necessarily be required if the lens 32 was colored. In still other examples, the color of the LED 44 and the color of the filter cap 50 and/or lens 32 are designed specifically to combine to create a red or green light as required by the above-noted marine navigational standards.

Other examples of matching colored components and lights to be emitted from luminaire subassemblies 10, 10', 100, 100' include those having a yellow color, such as for towing lights. Note that the colored component could have any color, depending on the color of the light the luminaire subassembly 10, 10', 100, 100' is intended to emit, including red, orange, yellow, green, blue, indigo, or violet, or any color in those color families. The colored component and LED 44 may instead both be white or clear.

Figure 3A:
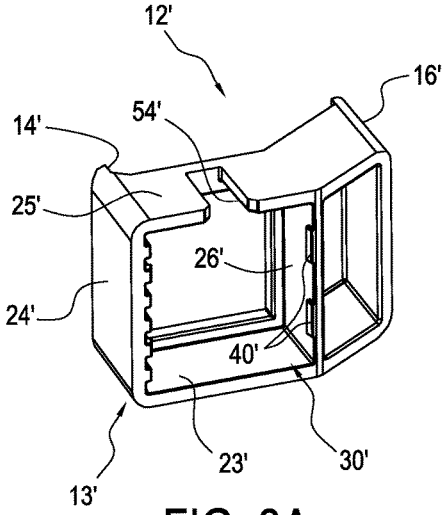
FIGS. 3A-3C illustrate views of a port-side cutoff sub-housing.
Figure 3B:
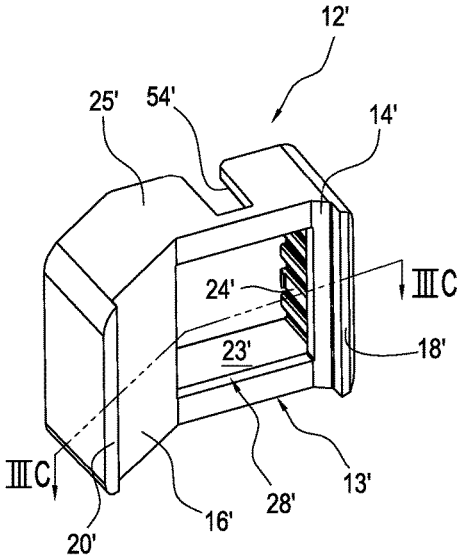
Figure 3C:
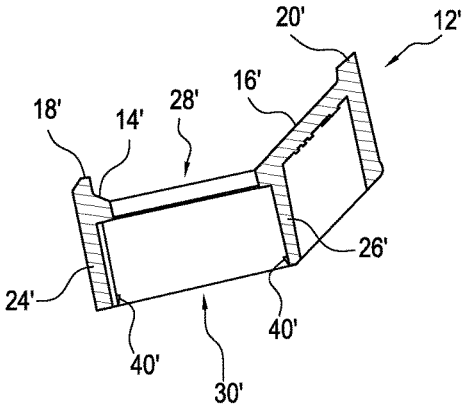

Additionally, in some of today's marine navigational light fixtures, especially due to the cutoff surfaces 18, 20, 18', 20', it is not possible to tell from certain perspectives whether the light is on. Therefore, the present design includes the above-noted telltale 52 on top of the luminaire subassembly 10, 10', 100, 100' that is visible from the side and rear of the assembled light fixture. As shown in FIGS. 1A-1B, 4A-4B, and 6A-6B, the telltale 52 projects from and is part of the base 36 of the lens 32, which is placed on the opposite side of the filter cap 50 from the LED 44. Thus, the telltale 52 has the same color as the light given off by the luminaire subassembly 10, 10'. (Note that this is true even when no filter cap is provided, as in the luminaire subassemblies 100, 100' of FIGS. 6A-7, because in those examples, the LED 44 itself gives off colored light.) The cutoff sub-housing 12, 12' may include a slot 54, 54' in the main frame 13, 13' that allows the telltale 52 to project from the cutoff sub-housing 12 when the lens 32 is assembled in the main frame 13, 13'. While FIGS. 1A-2C show a starboard-side cutoff sub-housing 12, note that the port-side cutoff sub-housing 12' shown in FIGS. 3A-3C is a mirror image, such that the telltale 52 would be able to project from the slot 54' on the top side 25' of the main frame 13'. The same lens 32 and light engine 22 designs can then be used with the port-side cutoff housing 12' as with the starboard-side cutoff housing 12.

Providing the exemplary independently-testable luminaire subassemblies 10, 10', 100, 100' including cutoff sub-housings 12, 12' described above not only reduces time and cost associated with the testing of a new light fixture, it also reduces time and cost during the manufacturing process. The main housings that hold the luminaire subassemblies 10, 10', 100, 100' can be much simpler, as they no longer need to provide the cutoffs themselves, and therefore are easily moldable. The tolerances for the main housings can also be more relaxed, as the cutoff sub-housing 12, 12' is the component which provides the sharp cutoff required by the ISO and ABYC standards. It is easier to make custom main housing designs for a given customer when those main housings need only to have a space configured to hold the luminaire subassemblies 10, 10', 100, 100'.

FIGS. 9A-11B illustrate different examples of main housings into which the luminaire subassemblies 10, 100 described herein above may be inserted. In each example, a main housing 402, 510, 608 holds one or more cutoff sub-housings. The cutoff sub-housings are configured to be held in recesses 406, 408, 506, 508, 610 in the main housings 402, 510, 608. Each recess 406, 408, 506, 508, 610 is configured such that the main housing 402, 510, 608 does not interfere with the light emitted from the LED 44 within the specified arc of visibility.

Figure 9A:
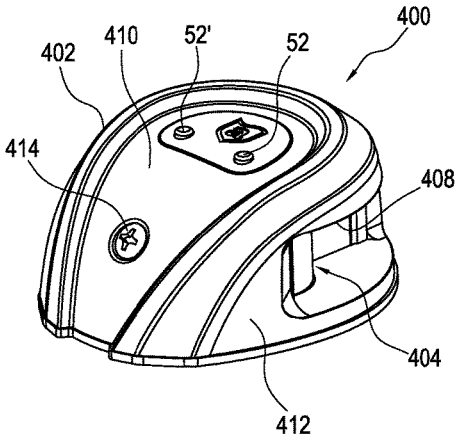
FIGS. 9A-11B illustrate various examples of marine navigational light fixtures, including various main housings and the subassemblies of the present disclosure.
Figure 9B:
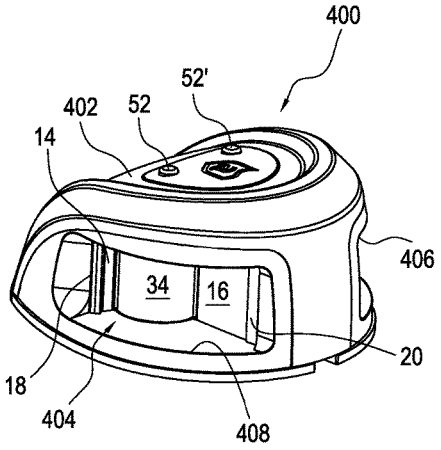

FIGS. 9A and 9B show a first embodiment of a light fixture 400, including main housing 402 holding two luminaire subassemblies. Although only the starboard-side luminaire subassembly 404 is shown herein, a recess 406 for the port-side luminaire subassembly can be seen in FIG. 9B. Note that the luminaire subassemblies could be either the embodiments described with respect to FIGS. 1A-1B and 5 or the embodiments described with respect to FIGS. 6A-6B and 7. The light fixture 400 can be mounted on a horizontal surface, such as a deck of the boat. It can be seen that the recess 408 holding luminaire subassembly 404 is shaped such that the cutoff surfaces 18, 20 at the ends of sidewalls 14, 16 are the only elements in the way of the light emanating from the convex surface 34 of the lens 32, thereby ensuring that the ISO and ABYC standards are complied with. It can also be seen that the main housing 402 is designed with apertures in its top surface through which the telltales 52, 52' of each of the starboard-side and port-side luminaire subassemblies project when the cutoff sub-housings are assembled in the main housing 402. To assemble the light fixture 400, a cover plate 410 can be removed from a base 412. The luminaire subassemblies can be placed in the base 412 such that the backs 30, 30' of the main frames 13, 13' face one another. The main housing 402 can have designated areas inside the base 412 (formed, for example, as recesses, molded outlines, or retaining tabs) such that the luminaire subassemblies are installed in the correct orientation. Then, the cover plate 410 can be placed back on the base 412 and connected thereto, for example, by a screw 414.

Figure 10A:
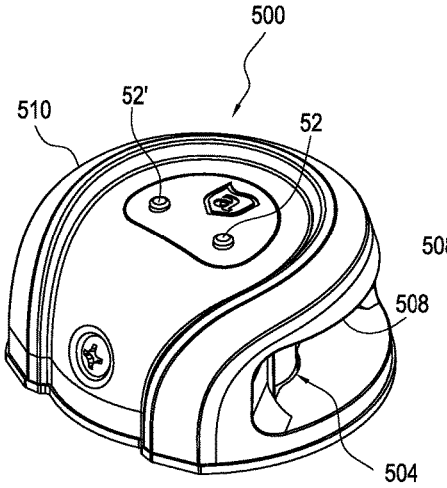
Figure 10B:
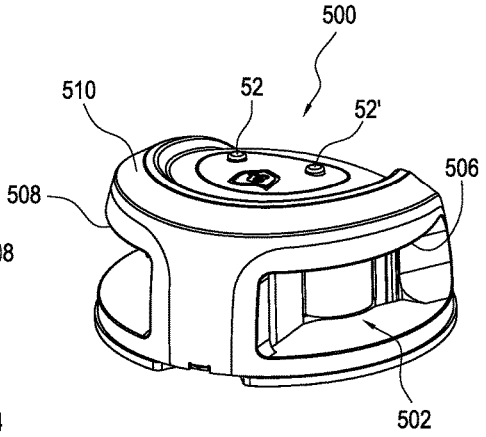

FIGS. 10A and 10B show different views of an alternative light fixture 500 with a slightly different design, but still for mounting on a horizontal surface on the boat. This light fixture 500 also includes both a port-side luminaire subassembly 502 held in recess 506 and a starboard-side luminaire subassembly 504 held in recess 508. All other aspects of the light fixture 500 besides the design of the main housing 510 are the same as those in the other Figures described hereinabove, and will not be described again for purposes of brevity.

Figure 11A:
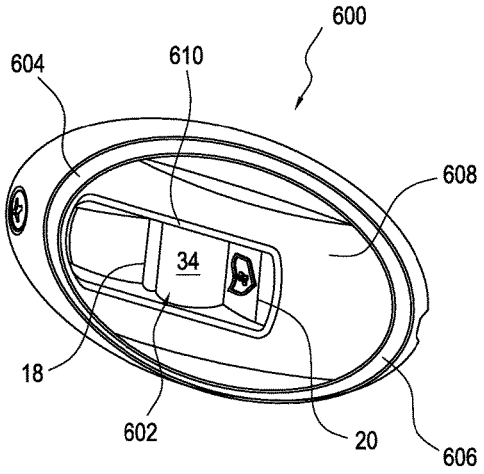
Figure 11B:
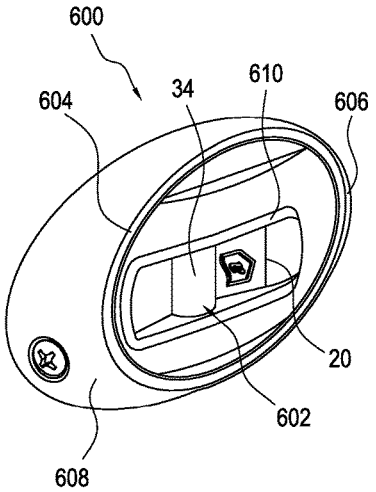

FIGS. 11A and 11B show views of a light fixture 600 to be mounted on a vertical surface on the boat, such as on the side of the boat. This particular light fixture 600 would be mounted on the starboard side of the boat in the orientation shown, as the luminaire subassembly 602 therein needs to be the only component cutting off the emitted light at a certain angle. For example, the rear curved wall 604 of the recess 610 in the main housing 608 of the light fixture 600 is set back far enough that it does not interfere with light that is cutoff by the cutoff surface 18. The front wall 606 of the recess 610 must be designed such that it does not interfere with light that is cut off by cutoff surface 20. Note that the light fixture 600 could be flipped bottom-to-top and placed in that orientation on the port side of a boat.

Thus, it can be seen that many different light fixtures 400, 500, 600 can hold the luminaire subassemblies 10, 10', 100, 100' of the present disclosure (and/or the starboard-side analogues). This allows a single cutoff sub-housing design to be certified as meeting ISO and ABYC standards, and used in multiple different main housings to create a light fixture.

In the above description, certain terms have been used for brevity, clarity, and understanding. No unnecessary limitations are to be inferred therefrom beyond the requirement of the prior art because such terms are used for descriptive purposes and are intended to be broadly construed. The different assemblies described herein may be used alone or in combination with other assemblies. It is to be expected that various equivalents, alternatives and modifications are possible within the scope of the appended claims. Each limitation in the appended claims is intended to invoke interpretation under 35 U.S.C. § 112(f), only if the terms "means for" or "step for" are explicitly recited in the respective limitation.

What is claimed is:

1. A marine navigational light fixture comprising:
- a light source;
- a cutoff sub-housing holding the light source and having:
  - a main frame having first and second laterally opposite sides;
  - first and second sidewalls projecting from the first and second sides of the main frame, respectively; and
  - first and second cutoff surfaces located on the first and second sidewalls, respectively, wherein the first and second cutoff surfaces are configured to provide practical cutoff of light emitted from the light source outside of a specified arc of visibility; and
- a main housing holding the cutoff sub-housing;
- wherein the specified arc of visibility is defined by at least one of the ABYC A-16 standard and the ISO 19009 standard;
- wherein the first and second sidewalls are angled outwardly away from each other; and
- wherein the first and second cutoff surfaces project from the first and second sidewalls, respectively, and the specified arc of visibility is defined between a first line connecting an origin on the light source to the first cutoff surface and a second line connecting the origin on the light source to the second cutoff surface.

2. The marine navigational light fixture of claim 1, wherein the specified arc of visibility is 112.5 degrees.

3. The marine navigational light fixture of claim 1, further comprising a lens held by the main frame and through which the emitted light passes.

4. The marine navigational light fixture of claim 3, further comprising a telltale that projects from the lens and through a slot in the main frame when the lens is assembled in the main frame.

5. The marine navigational light fixture of claim 4, further comprising a recess in the main housing;
- wherein the cutoff sub-housing is configured to be held in the recess; and
- wherein the recess is configured such that the main housing does not interfere with the light emitted within the specified arc of visibility.

6. The marine navigational light fixture of claim 5, further comprising an aperture in the main housing through which the telltale projects when the cutoff sub-housing is assembled in the main housing.

7. The marine navigational light fixture of claim 1, further comprising a printed circuit board (PCB) that supports the light source, wherein the light source is a light emitting diode (LED).

8. The marine navigational light fixture of claim 7, wherein a color of the PCB is in the same color family as a color of the light emitted from the LED.

9. A luminaire subassembly for a marine navigational light fixture, the luminaire subassembly comprising:
- a light engine including a printed circuit board (PCB) supporting a light emitting diode (LED);
- a cutoff sub-housing holding the light engine and configured to provide practical cutoff of light emitted from the LED outside of a specified arc of visibility, wherein the cutoff sub-housing includes:
  - a main frame having first and second laterally opposite sides;
  - first and second sidewalls projecting from the first and second sides of the main frame, respectively; and
  - first and second cutoff surfaces located on the first and second sidewalls, respectively; and
- a colored component having a color that is in the same color family as a color of light emitted from the luminaire subassembly, wherein the colored component comprises at least one of:
  - a lens supported in the cutoff sub-housing and through which the light emitted from the LED passes;
  - a filter cap supported on the PCB and through which the light emitted from the LED passes;
  - the PCB; and
  - a telltale projecting from the lens.

10. The luminaire subassembly of claim 9, wherein the specified arc of visibility is defined by at least one of the ABYC A16 standard and the ISO 19009 standard.

11. The luminaire subassembly of claim 10, wherein the specified arc of visibility is 112.5 degrees.

12. The luminaire subassembly of claim 9, wherein the first and second sidewalls are angled outwardly away from each other.

13. The luminaire subassembly of claim 12, wherein the first and second cutoff surfaces project from the first and second sidewalls, respectively, and the specified arc of visibility is defined between a first line connecting an origin on the LED to the first cutoff surface and a second line connecting the origin on the LED to the second cutoff surface.

14. The luminaire subassembly of claim 9, wherein the cutoff sub-housing is configured to be held in a recess of a main housing, and wherein the recess is configured such that the main housing does not interfere with the light emitted from the LED within the specified arc of visibility.

15. The luminaire subassembly of claim 14, wherein the main housing includes an aperture through which the telltale projects when the cutoff sub-housing is assembled in the main housing.

16. The luminaire subassembly of claim 9, wherein the PCB is the colored component, wherein the lens and the telltale are clear, and wherein no filter cap is provided.

17. A marine navigational light fixture comprising:

a light source;

a cutoff sub-housing holding the light source and having:

a main frame having first and second laterally opposite sides;

first and second sidewalls projecting from the first and second sides of the main frame, respectively, wherein the first and second sidewalls are angled outwardly away from each other; and first and second cutoff surfaces located on the first and second sidewalls, respectively, wherein the first and second cutoff surfaces are configured to provide practical cutoff of light emitted from the light source outside of a specified arc of visibility; and a main housing holding the cutoff sub-housing;

wherein the first and second cutoff surfaces project from the first and second sidewalls, respectively, and the specified arc of visibility is defined between a first line connecting an origin on the light source to the first cutoff surface and a second line connecting the origin on the light source to the second cutoff surface.

18. The marine navigational light fixture of claim 17, wherein the specified arc of visibility is defined by at least one of the ABYC A-16 standard and the ISO 19009 standard.

19. The marine navigational light fixture of claim 17, further comprising a recess in the main housing;

wherein the cutoff sub-housing is configured to be held in the recess; and wherein the recess is configured such that the main housing does not interfere with the light emitted within the specified arc of visibility.

20. The marine navigational light fixture of claim 17, further comprising a printed circuit board (PCB) that supports the light source, wherein the light source is a light emitting diode (LED), and wherein a color of the PCB is in the same color family as a color of the light emitted from the LED.

* * * * *